US007036813B2

(12) United States Patent
Asada

(10) Patent No.: US 7,036,813 B2
(45) Date of Patent: May 2, 2006

(54) RECORDING MEDIUM FEED APPARATUS

(75) Inventor: Tetsuo Asada, Kuwana (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 70 days.

(21) Appl. No.: 10/914,122

(22) Filed: Aug. 10, 2004

(65) Prior Publication Data

US 2005/0062217 A1 Mar. 24, 2005

(30) Foreign Application Priority Data

Aug. 12, 2003 (JP) ..... 2003-292422

(51) Int. Cl.
*B65H 3/06* (2006.01)

(52) U.S. Cl. ..... 271/117; 271/9.09; 271/162

(58) Field of Classification Search ..... 271/117, 271/162, 116, 113, 9.09; 399/392, 393; 347/104
See application file for complete search history.

(56) References Cited

U.S. PATENT DOCUMENTS 3,599,971 A * 8/1971 Morioka ..... 271/117
3,689,062 A * 9/1972 Minoru ..... 271/117
6,648,322 B1 * 11/2003 Park ..... 271/117

FOREIGN PATENT DOCUMENTS

JP A 7-42013 5/1995
JP A 11-171360 6/1999

* cited by examiner

*Primary Examiner*—Donald P. Walsh
*Assistant Examiner*—Jeremy Severson
(74) *Attorney, Agent, or Firm*—Oliff & Berridge, PLC

(57) ABSTRACT

A recording medium feed apparatus has a manual feed tray provided in open or closed state, a feed roller feeding a recording portion a recording medium on the manual feed tray, an arm body having a first end portion rotatably attached to a housing and a second end portion, a feed roller unit having a front end portion provided with the feed roller and a base end portion rotatably attached to the second end portion, and a driving source transferring driving force to the feed roller, wherein the arm body and the feed roller unit are vertically housed inside the housing when the manual feed tray is closed, and as the manual feed tray changes from closed to opened state, the arm body tilts toward outside, while a folding angle of the feed roller increases so that the feed roller abuts against a recording medium on the manual feed tray.

5 Claims, 11 Drawing Sheets

RECORDING MEDIUM FEED APPARATUS

BACKGROUND OF THE INVENTION

1. Field of the Invention

The present invention relates to a recording medium feed apparatus for feeding a recording medium into a housing of an image recording apparatus by means of a manual feed tray provided openably and closably with respect to the housing of the image recording apparatus.

2. Description of the Related Art

An image recording apparatus for recording an image on a recording medium such as paper is often designed so that a recording medium can be fed (supplied) not only from a paper feed cassette built in a housing of the image recording apparatus but also from a manual feed tray provided openably and closably in a side surface of the housing. In such recording medium feed apparatus using a manual feed tray, a feed roller for separating and feeding (supplying) recording media one by one is disposed to abut against a recording medium mounting surface of the manual feed tray. The recording media are inserted between the feed roller and the manual feed tray so as to push up the feed roller. Thus, the feed roller abuts against the uppermost recording medium.

Therefore, in order to always bring the feed roller in such a manual feed tray into contact with the uppermost recording medium regardless of the number of recording media stacked thereon, for example, a swinging unit for swinging a feed roller 32 provided in the front end of a pendulum arm 71 rotatable around a pivot axis portion 70 is used as shown in FIG. 12A. To swing the arm 71, a certain length (L) in the feed (paper feed) direction has to be secured to install the feed roller unit having the feed roller 32 and the arm 71. Accordingly, when the feed roller unit is disposed inside the housing 4 near the manual feed tray, there occurs a problem that a space to be occupied inside the housing 4 by the other units is reduced, or miniaturization of the housing as a whole is prevented.

In order to reduce the space occupied by the feed roller unit inside the housing (for example, to reduce the length required for installation thereof into L/2), it can be considered that the arm 71 of the feed roller unit is shortened as shown in FIG. 12B, or the pivot axis portion 70 of the pendulum arm 71 is disposed as closely to the housing side surface as possible to thereby reduce the occupied space as shown in FIG. 12C. When the arm 71 is shortened as shown in FIG. 12B, a contact position Q of the feed roller with the uppermost recording medium P is shifted largely (ΔL) upstream or downstream in the feed (paper feed) direction in accordance with the number of stacked recording media P (the total thickness of the recording media). Thus, stability in feeding (supplying) the recording media is lowered. On the other hand, assume that the pivot axis portion 70 of the pendulum arm 71 is disposed as closely to the housing side surface as possible as shown in FIG. 12C. The arm angle of the feed roller unit abutting against the manual feed tray 30 when the length of the arm 71 is not reduced is an angle θ4 in the case shown in FIG. 12A, while the angle is increased to an angle θ5 (>θ4) in the case shown in FIG. 12C. Thus, the load to depress the paper (recording media) increases so that a trouble such as double paper feed in which two or more sheets of paper are fed simultaneously is apt to occur in the recording medium feed (paper feed).

In order to solve the foregoing problem without shortening the arm or disposing the pivot axis portion of the arm as closely to the housing side surface as possible in such a manner, for examples, JP-A-H11-171360 discloses a configuration in which a frame having a feed roller unit attached thereto and a manual feed tray are linked by a link so that the feed roller unit is rotated and displaced largely between a driving position and a housing position of the feed roller unit in accordance with the open/close operation of the manual feed tray.

In JP-A-H11-171360, a feed roller (referred to as "pickup roller" in JP-A-H11-171360) is provided in a front end portion of the arm of the feed roller unit, while a conveyance roller (referred to as "paper feed roller" in JP-A-H11-171360) is provided in a base end portion of the arm. When the manual feed tray in the side surface of the housing is opened, the arm rotates around the conveyance roller as a fulcrum through the frame linked with the manual feed tray by the link. Thus, the feed roller projects to the outside of the housing, and moves down onto the manual feed tray. On the other hand, when the manual feed tray is closed, the arm is inclined to have a posture with which the feed roller is lifted up. Thus, the feed roller unit is retained inside the housing.

JP-A-H11-171360 (FIGS. 3 and 4) is referred to as a related art.

In the configuration according to JP-A-H11-171360, the arm is retained in a posture with a large inclination angle in the position where the feed roller unit is housed, so that the occupied space can be reduced in the feed (paper feed) direction. However, the space can be reduced merely in accordance with the inclination of the arm itself. In order to expand the space to be occupied by the other units inside the housing or to miniaturize the housing as a whole, it is requested to further reduce the occupied space of the feed roller unit when it is housed.

In addition, in the feed (paper feed) using the manual feed tray as described above, it is also requested to make it easy to insert recording media to thereby improve the convenience of users.

SUMMARY OF THE INVENTION

The object of the invention is to provide a recording medium feed apparatus using a manual feed tray, in which an occupied space required inside a housing by the manual feed tray can be reduced, while the feed (supply) of recording media can be stabilized, and the recording media can be inserted easily.

The invention provides a recording medium feed apparatus having: a manual feed tray provided openably and closably with respect to a housing of an image recording apparatus having a recording portion that records an image on a recording medium; a feed roller that feeds the recording portion with a recording medium mounted on the manual feed tray in an opened state; an arm body having a first end portion and a second end portion, the first end portion being rotatably attached to the housing; a feed roller unit having a front end portion and a base end portion, the front end portion being provided with the feed roller, the base end portion being rotatably attached to the second end portion of the arm body; and a driving source provided in the housing and that transfers a driving force to the feed roller, wherein the arm body and the feed roller unit are housed substantially vertically inside the housing when the manual feed tray is in a closed state with respect to the housing, and as the manual feed tray changes from the closed state to the opened state, the arm body in a substantially vertical state is inclined toward an outside of the housing, while a folding angle of the feed roller unit with respect to the arm body increases so that the feed roller abuts against an uppermost surface of a recording medium mounted on a mounting surface of the manual feed tray.

Therefore, the arm body and the feed roller unit can be retained with a reduced folding angle and to be each erected substantially vertically at the time of retraction in spite of a pivot axis portion of the arm body installed inside the housing. The occupied space in the feed (paper feed) direction inside the housing can be therefore reduced on a large scale. When the manual feed tray is opened, the folding angle of the arm body and the feed roller unit increases so that the feed roller can be disposed in an optimal position of the top surface of the recording medium mounted on the mounting surface of the manual feed tray. Accordingly, even when the occupied space of the arm body and the feed roller unit when they are retracted is reduced as described above, there is no fear that the feed performance of the recording media is lost.

DETAILED DESCRIPTION OF THE PREFERRED EMBODIMENTS

Figure 1:
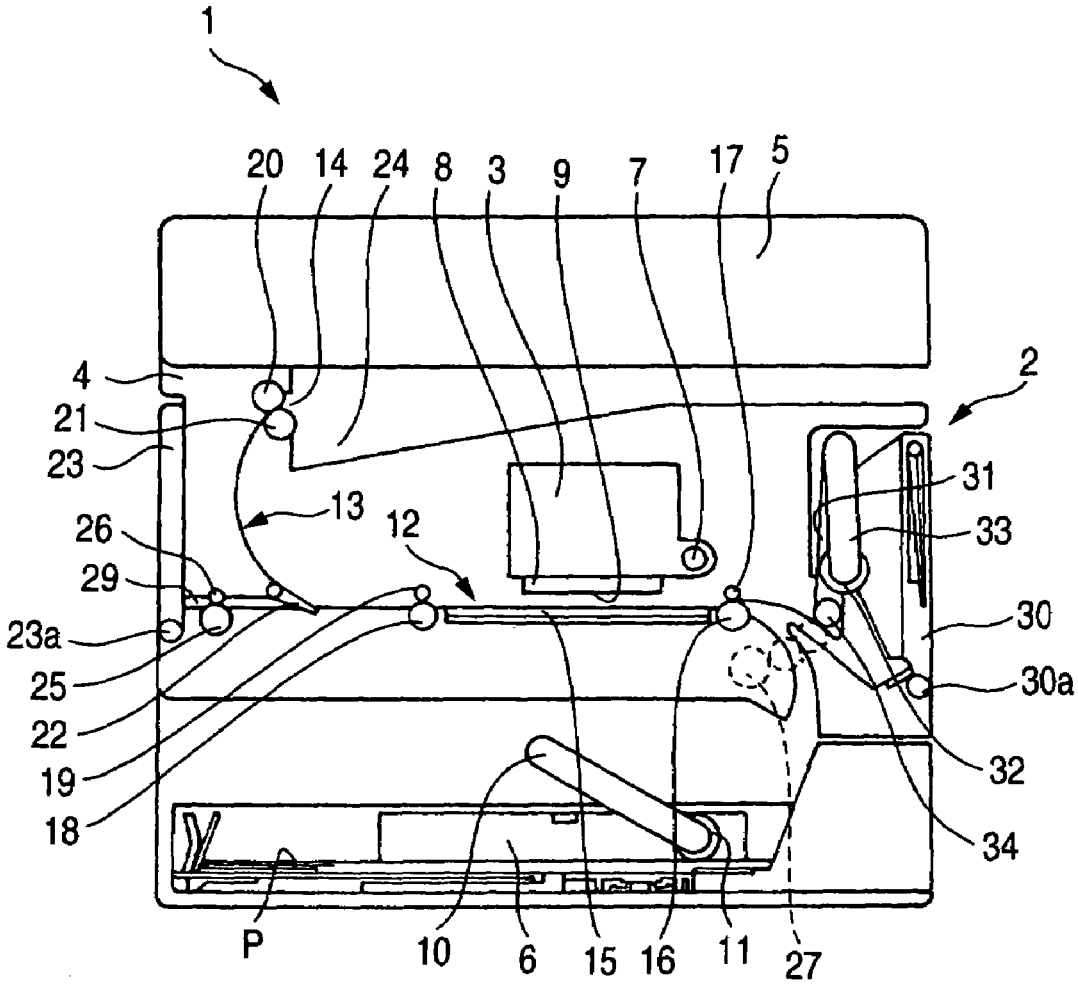
FIG. 1 is a side sectional view of image recording apparatus mounted with recording medium feed apparatus according to an embodiment of the invention.
Figure 2:
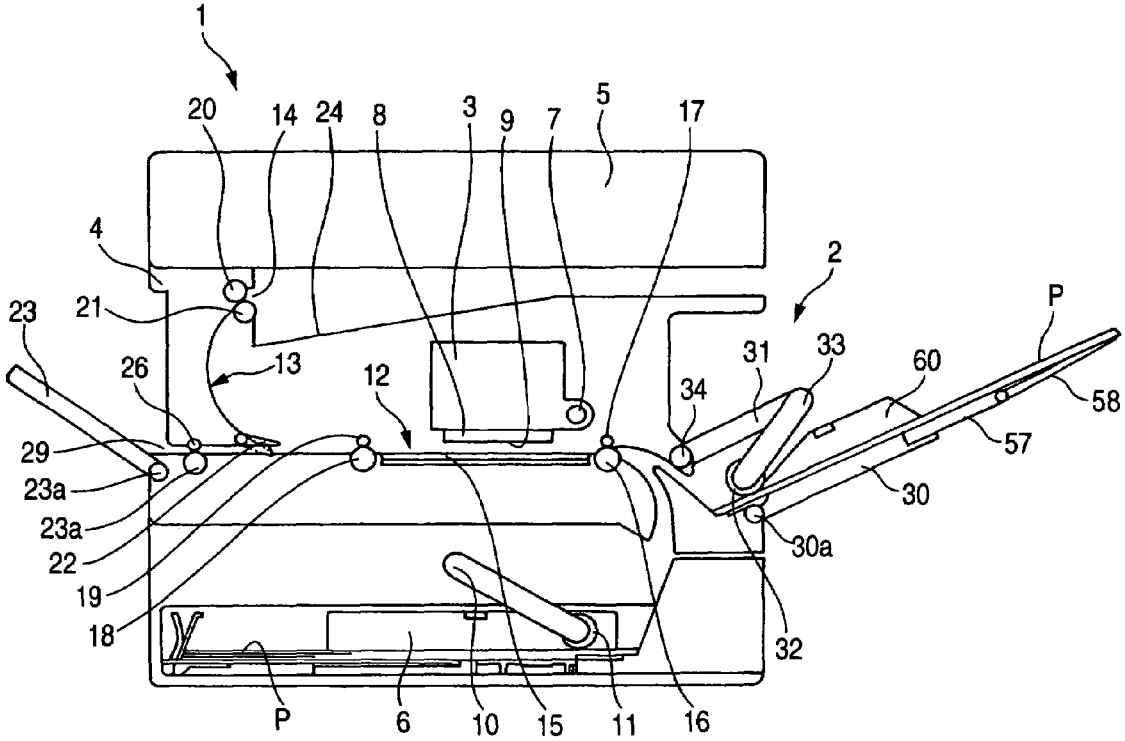
FIG. 2 is a side sectional view of the image recording apparatus when a manual feed tray and a non-inversion paper delivery tray are opened.
Figure 3:
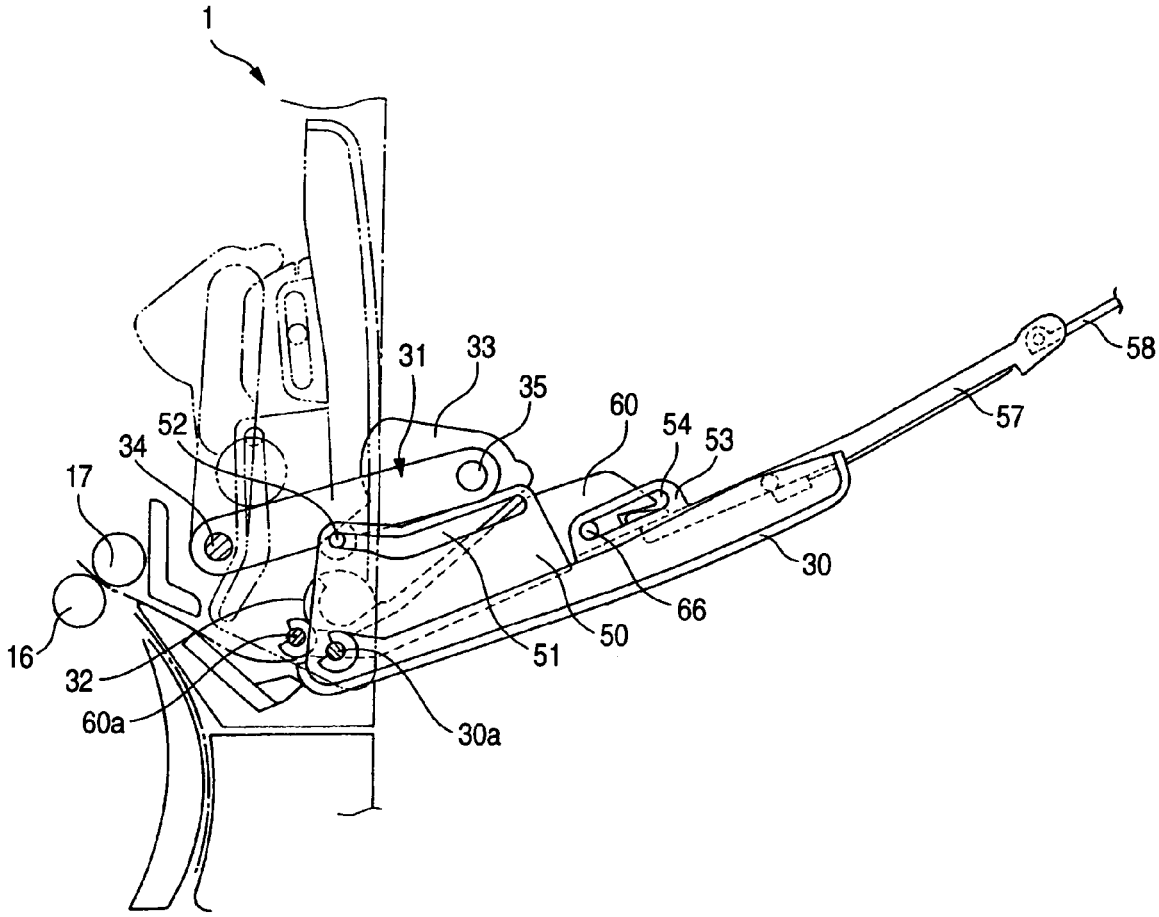
FIG. 3 is a main portion side sectional view showing the operation in which the manual feed tray is opened.
Figure 4:
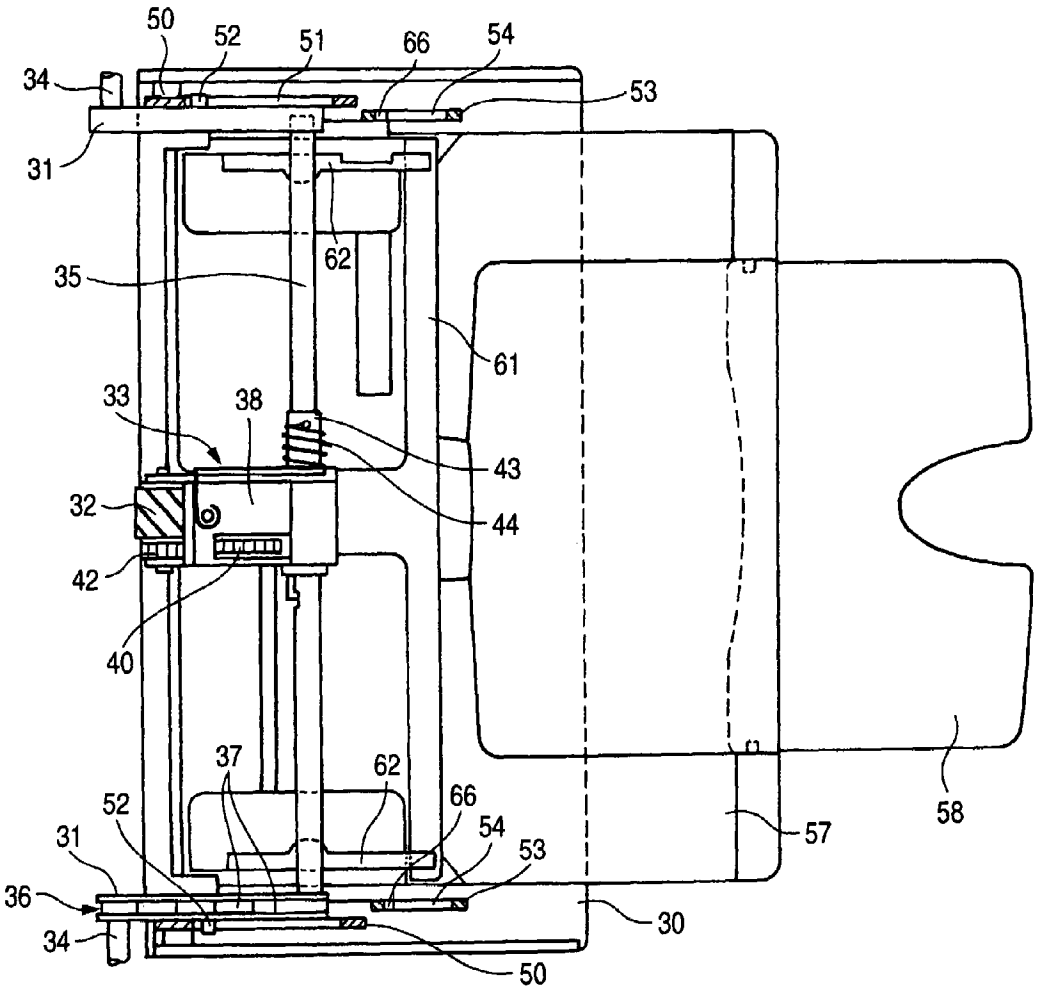
FIG. 4 is a plan view showing the positional relationship between arm bodies and the manual feed tray in the opened state.
Figure 5:
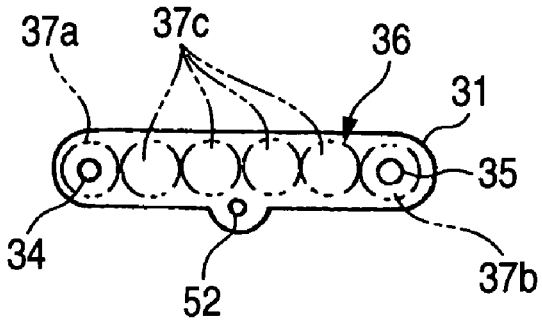
FIG. 5 is a side view of the arm body.
Figure 6:
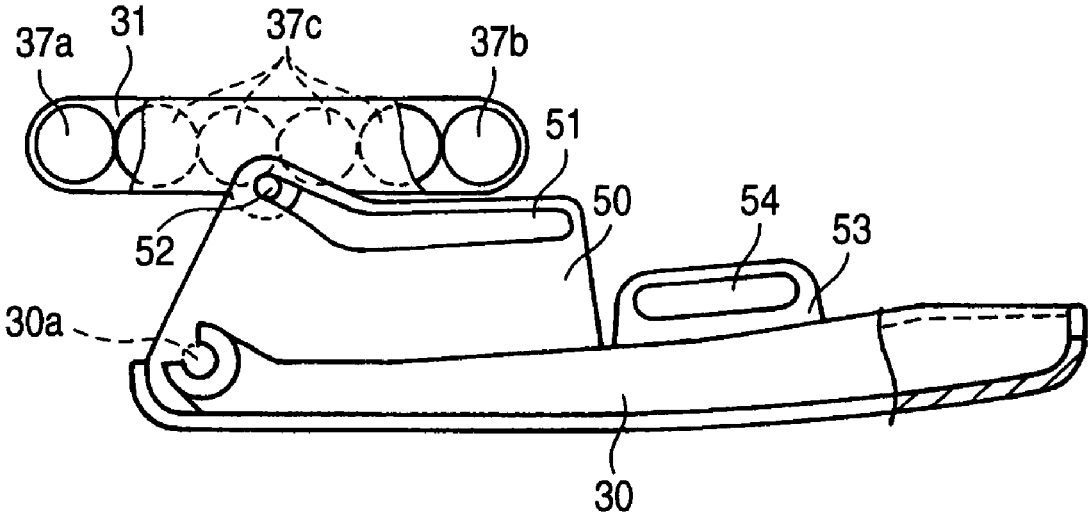
FIG. 6 is a side view of the arm body and the manual feed tray.
Figure 7:
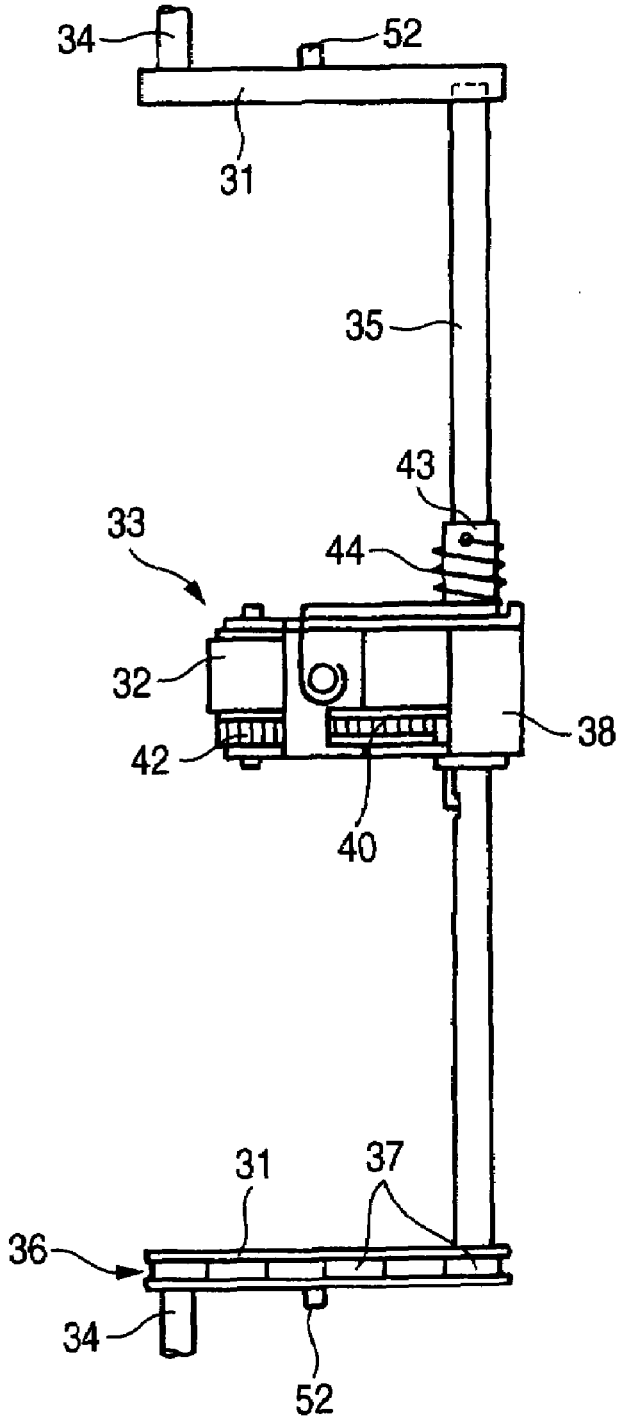
FIG. 7 is a plan view of the arm bodies and a feed roller unit.
Figure 8:
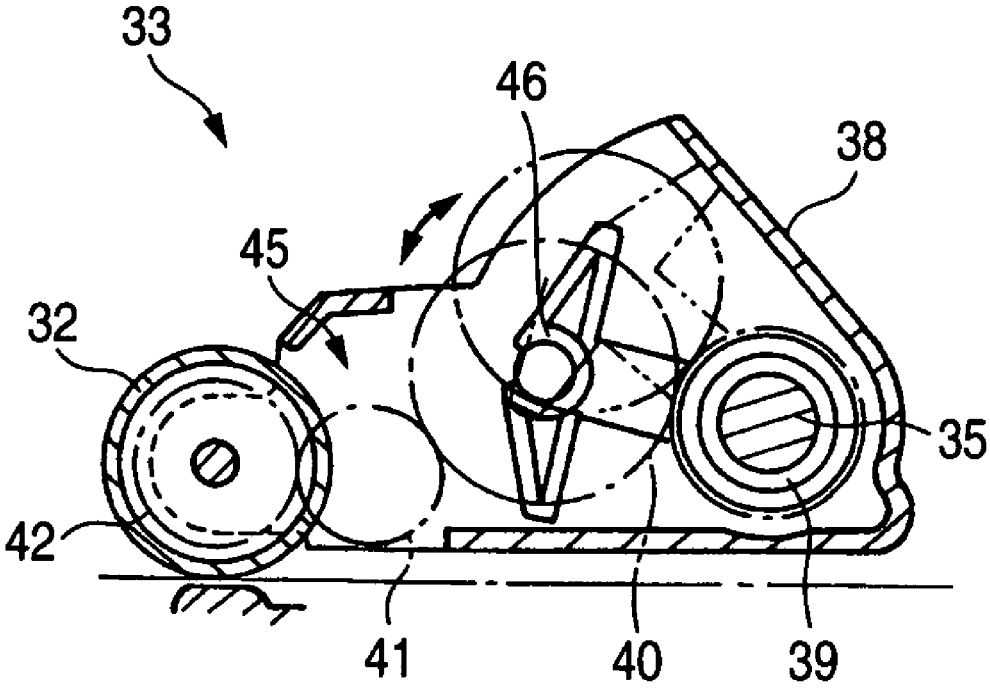
FIG. 8 is a side sectional view of the feed roller unit.
Figure 9:
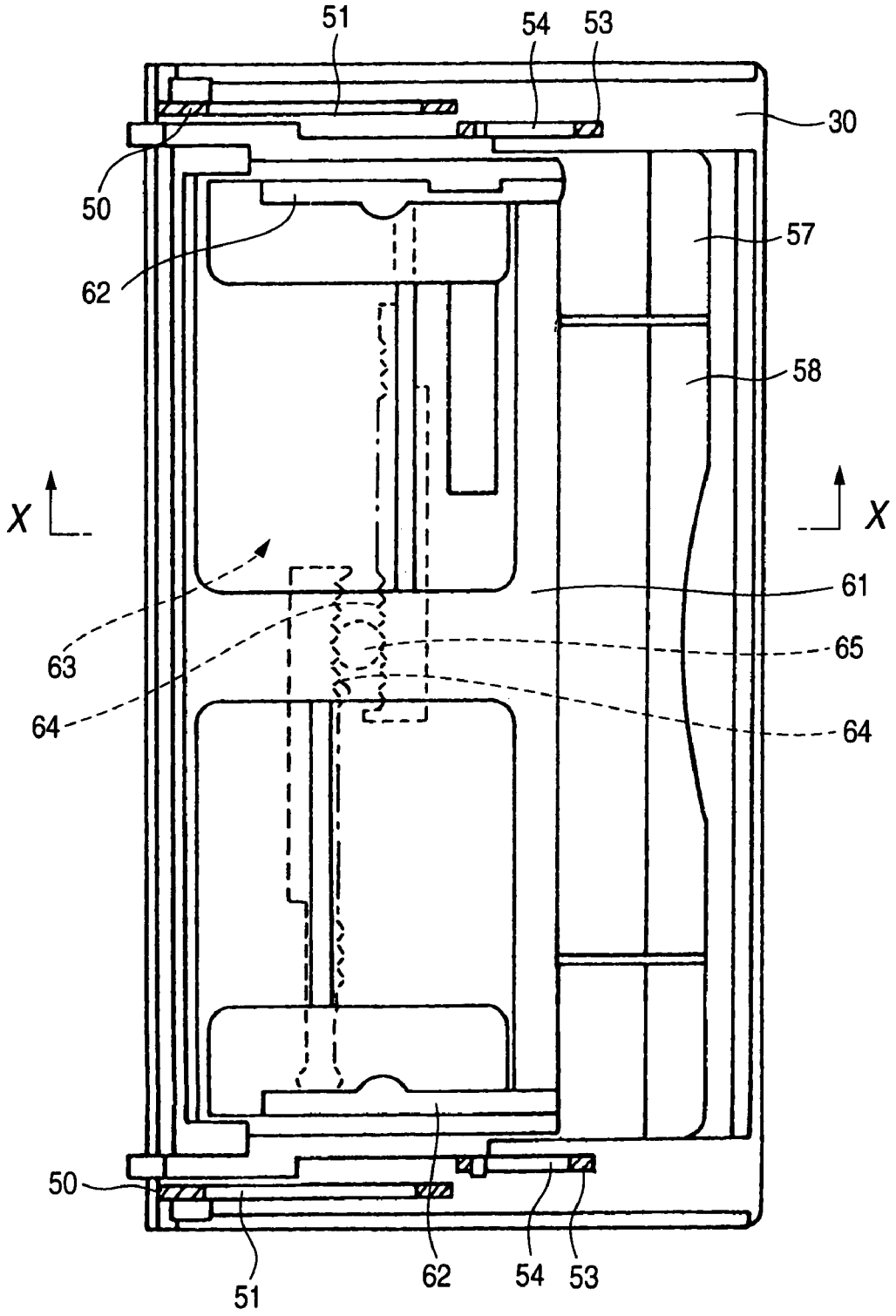
FIG. 9 is a plan view of the manual feed tray.
Figure 10:
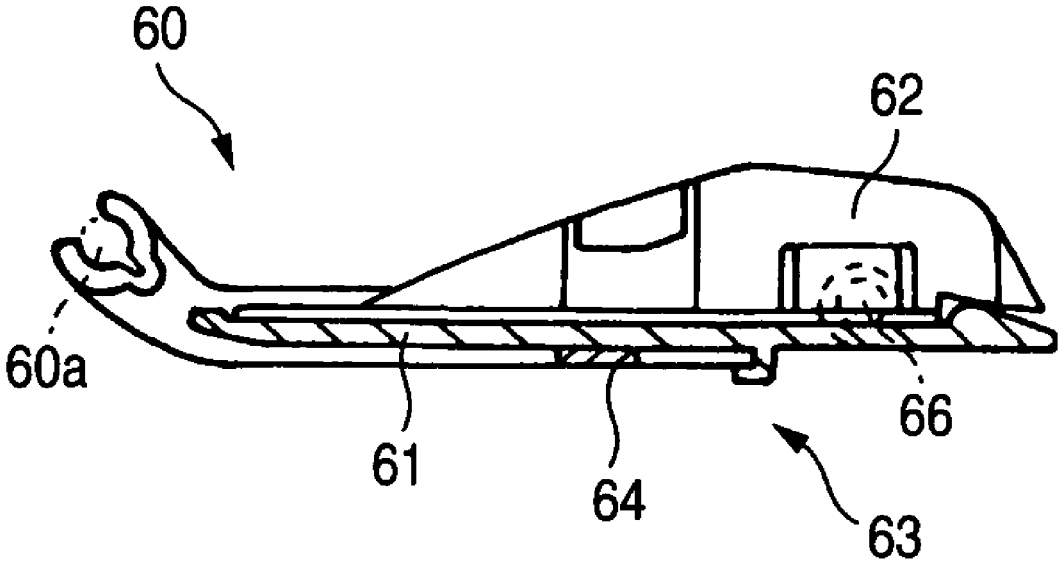
FIG. 10 is a partial sectional view taken on line X—X in FIG. 9.
Figure 11:
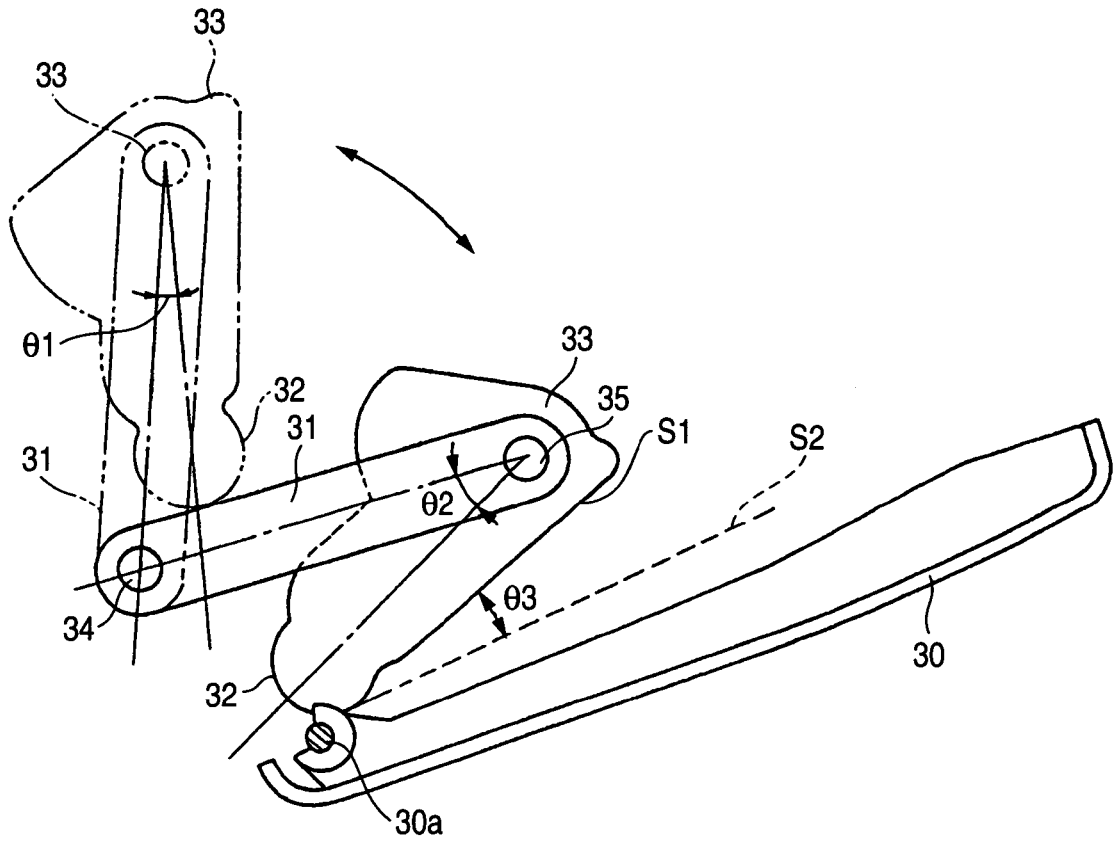
FIG. 11 is an explanatory view showing the positional relationship when the arm bodies and the manual feed tray are in the opened state.
Figure 12A:
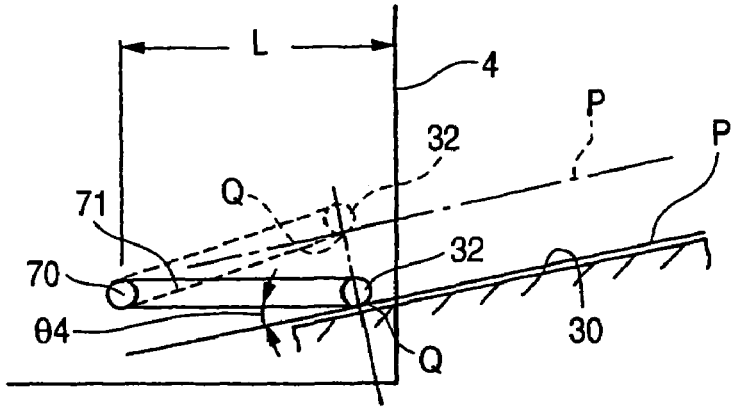
FIG. 12A Related Art
FIGS. 12A to 12C are explanatory views showing a feed roller unit in the background art.
Figure 12B:
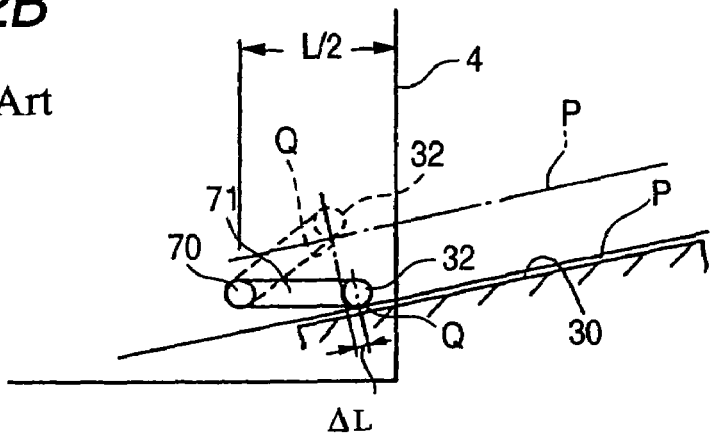
FIG. 12B Related Art
Figure 12C:
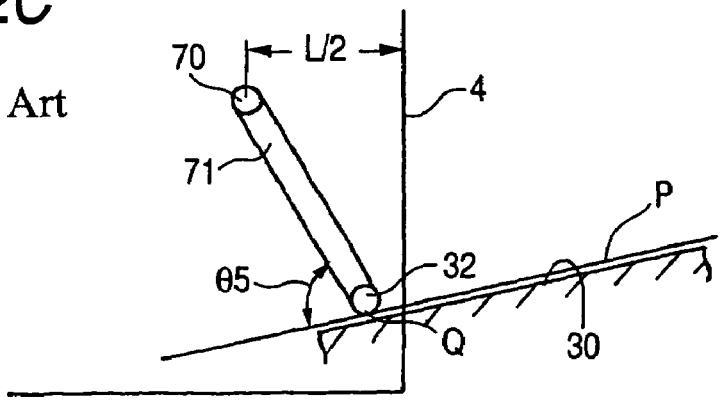
FIG. 12C Related Art

An embodiment of the invention will be described below with reference to the drawings. FIG. 1 is a side sectional view of image recording apparatus mounted with recording medium feed apparatus according to the embodiment of the invention. FIG. 2 is a side sectional view of the image recording apparatus when a manual feed tray and a non-inversion paper delivery tray are opened. FIG. 3 is a main portion side sectional view showing the operation in which the manual feed tray is opened. FIG. 4 is a plan view showing the positional relationship between arm bodies and the manual feed tray in the opened state. FIG. 5 is a side view of the arm body. FIG. 6 is a side view of the arm body and the manual feed tray. FIG. 7 is a plan view of the arm body and a feed roller unit. FIG. 8 is a side sectional view of the feed roller unit. FIG. 9 is a plan view of the manual feed tray. FIG. 10 is a partial sectional view taken on line X—X in FIG. 9. FIG. 11 is an explanatory view showing the positional relationship when the arm body and the manual feed tray are in the opened state.

The first embodiment of the recording medium feed apparatus according to the invention is applied to a recording medium feed apparatus 2 to be mounted on an image recording apparatus 1 having a recording head using an inkjet recording system.

As shown in FIG. 1, the image recording apparatus 1 in the first embodiment includes a substantially box-like housing 4, a recording head 8 using an inkjet recording system, a document reading portion 5 and a paper feed cassette 6. The recording head 8 is provided substantially in the central portion of the inside of the housing 4. The reading portion 5 is provided on the top of the housing 4. The paper feed cassette 6 with paper P as recording media stored and stacked therein is provided in the lower portion of the housing 4.

A carriage 3 mounted with the recording head 8 is slidably attached to a round-shaft-like guide shaft 7 extending in the depth direction of the housing 4. The recording head 8 is a head capable of color recording, and having nozzle portions 9 on its bottom side. The nozzle portions 9 are to eject color inks of yellow, magenta, cyan and black respectively. A platen 15 is provided to face the nozzle portions 9 so as to form a recording portion between the nozzle portions 9 and the platen 15.

Though not shown, a transparent plate for mounting a document thereon or known reading means such as a reading unit using a CCD is applied to the reading portion 5.

In addition thereto, the housing 4 is provided with an operation panel portion (not shown) having ten keys or button keys for giving instructions of various operations, a liquid crystal panel for displaying instruction contents or displaying errors, and so on.

A paper feed roller 11 supported on a roller arm 10 is disposed in the paper feed cassette 6. The paper feed roller 11 is urged by the self-weight of the roller arm 10 or an urging unit (not shown) attached to the roller arm 10, so that the paper feed roller 11 always abuts against the uppermost surface of sheets of the paper P stacked in the paper feed cassette 6. The sheets of paper P are separated one by one by the paper feed roller 11, and conveyed in turn onto a conveyance path 12 which will be described later.

In addition, a manual feed tray 30 is provided in one side surface (right side surface in FIG. 1) of the housing 4, and a non-inversion paper delivery tray 23 is provided in the other side surface (left side surface in FIG. 1) opposed to the one surface. The manual feed tray 30 (multi-purpose (MP) tray) and the non-inversion paper delivery tray 23 are attached to the side surfaces of the housing 4 so as to close a paper feed portion and a non-inversion paper delivery portion 29 respectively when they are closed.

Basic paths for conveying the paper P include the conveyance path 12 and an inversion conveyance path 13. Through the conveyance path 12, an image is recorded on the upper surface, which is one surface of the paper P supplied from the paper feed cassette 6, in the recording portion, and the paper P is conveyed with the image-recorded surface (hereinafter referred to as "image surface") up as it is. Through the inversion conveyance path 13 continuously connected to the conveyance path 12, the paper P is conveyed and inverted substantially like a U-turn with the image surface of the paper P down. An inversion paper delivery portion 14 for discharging the inverted paper P is provided on the downstream side of the inversion conveyance path 13 in the conveyance direction. The sinking portion of the housing 4 outside the inversion paper delivery portion 14 and under the reading portion 5 corresponds to a paper delivery portion 24 to which the paper P is discharged from the inversion paper delivery portion 14.

A start end portion of the conveyance path 12 is formed substantially into a U-turn so as to convey the paper P from the paper feed cassette 6 provided in the lower portion of the housing 4 onto the platen 15 provided substantially in the central portion of the housing 4. In the recording portion, a gap between the nozzle portions 9 and the platen 15 corresponds to the conveyance path 12.

As a conveyance unit, a first driving roller (LF roller) 16 and a first driven roller 17 disposed above the first driving roller 16 so as to be opposed thereto are provided in the conveyance path 12 on the upstream side of the recording portion in the conveyance direction in order to feed the paper P toward the recording portion by a predetermined distance each time. A second driving roller 18 and a second driven roller 19 disposed above the second driving roller 18 so as to be opposed thereto are provided on the downstream side of the recording portion in the conveyance direction. Further in the inversion conveyance path 13, a third driving roller 20 and a third driven roller 21 disposed above the third driving roller 20 so as to be opposed thereto are provided immediately before the inversion paper delivery portion 14 in order to discharge the paper P thereto. The second driven roller 19 and the third driven roller 21 are disposed on the side where they abut against the image surface of the paper P on which an image has been recorded. Thus, spur rollers are used as the driven rollers 19 and 21 in order to prevent the image surface from being stained.

An openable/closable conveyance member 22 is openably and closably provided in the inversion conveyance path 13 so as to form a part of the inversion conveyance path 13. When closed, the openable/closable conveyance member 22 can invert the paper P conveyed from the recording portion, and discharge the inverted paper P to the inversion paper delivery portion 14. When opened, the openable/closable conveyance member 22 can discharge the paper P conveyed from the recording portion to the non-inversion paper delivery portion 29 without inverting the paper P. The openable/closable conveyance member 22 forms the outer circumferential wall surface of the inversion conveyance path 13 normally when it is closed. When the openable/closable conveyance member 22 is displaced into the opened state in accordance with an external instruction signal, a manual operation of a user, or the like, the openable/closable conveyance member 22 is brought into the opened state where the openable/closable conveyance member 22 can block the conveyance of the paper P to the inversion conveyance path 13 and convey the paper P to the non-inversion paper delivery tray 23.

As shown in FIG. 2, the non-inversion paper delivery tray 23 is attached to a side surface of the housing 4 so that the top of the non-inversion paper delivery tray 23 is opened by a pivot 23*a* provided in the lower portion of the non-inversion paper delivery tray 23. When the non-inversion paper delivery tray 23 is opened, the paper P discharged from the non-inversion paper delivery portion 29 can be mounted thereon with the image surface of the paper P down.

In addition, a fourth driving roller 25 and a fourth driven roller 26 comprised of a spur roller and disposed above the fourth driving roller 25 so as to be opposed thereto are provided between the openable/closable conveyance member 22 and the non-inversion paper delivery tray 23. The fourth driving roller 25 and the fourth driven roller 26 encourages the paper P to be discharged to the non-inversion paper delivery tray 23.

The manual feed tray 30 provided in the side surface (right side surface in FIG. 1) of the housing 4 has the pivot 30*a* provided in the lower portion of the manual feed tray 30 and attached to the housing 4. Accordingly, when the manual feed tray 30 is opened with its top open to the outside of the housing 4 as shown in FIG. 2, the paper P as the recording media can be mounted on the manual feed tray 30. Not to say, OHP films, thick paper, etc. can be also used as the recording media.

Arm bodies 31 are attached to the housing 4 on the inner surface side of the manual feed tray 30 which is closed, so that the arm bodies 31 can rotate with respect to the housing 4. A feed roller unit 33 having a front end portion provided with a feed roller 32 (corresponding to the feed roller in claims) to be driven to feed (supply) the paper P to the recording portion is arranged to be foldable with respect to the front end portions of the arm bodies 31.

In this embodiment, a pair of arm bodies 31 are provided to be opposed to each other in the width direction (crossing the feed (paper feed) direction) of the manual feed tray 30 as shown in FIG. 4. First shafts 34 are provided in base end portions (first end portions) which are lower portions of the arm bodies 31 respectively. The arm bodies 31 are rotatably attached to the housing 4 through the first shafts 34 respectively. A driving source (motor) 27 for conveying the paper P is coupled with the first shafts 34. In addition, a second shaft 35 is attached to the paired arm bodies 31 so as to connect the front end portions (second end portions) of the arm bodies 31. The feed roller unit 33 is rotatably attached substantially to the central portion of the second shaft 35 in the width direction. The paper P conveyed by the feed roller 32 of the feed roller unit 33 is conveyed immediately upstream with respect to the first driving roller 16 and the first driven roller 17 located halfway in the conveyance path 12. At least the outer circumferential portion of the feed roller 32 is made from an elastic material such as a rubber material in order to enhance the frictional resistance to thereby convey the paper P one by one surely.

A driving force transfer unit 36 serving as a link unit for transferring the driving force from the driving source 27 to the second shaft 35 through the first shaft 34 is provided in one of the paired arm bodies 31. The driving force transfer unit 36 uses a configuration of gears 37 in which one or plural gears 37*c* (four in this embodiment) make a connection between a gear 37*a* attached to the first shaft 34 and a gear 37*b* attached to the second shaft 35 as shown in FIG. 5. Incidentally, as another form, the driving force transfer unit 36 may use a configuration in which an endless belt makes a connection between the first shaft 34 and the second shaft 35.

The arm bodies 31 are arranged so that their posture can be changed between an inclined posture where the arm bodies 31 are inclined to the outside of the housing 4 and an erect posture where the arm bodies 31 are retracted in the housing 4, as shown in FIG. 3, in accordance with the open/close operation of the manual feed tray 30. On the inner surface side of the manual feed tray 30 (on the top side in the opened state), a pair of flat-plate-like first guide pieces 50 are provided to be opposed to each other in the width direction of the manual feed tray 30 as shown in FIG. 4. The arm bodies 31 are guided by the first guide pieces 50 respectively. In this embodiment, as shown in FIGS. 3 and 6, slit-like guide grooves 51 long in the feed (paper feed) direction are formed in the first guide pieces 50 so that protrusion portions 52 provided in width-direction side portions of the arm bodies 31 so as to project to the outside are slidably fitted into the guide grooves 51 respectively. The arm bodies 31 are guided and inclined by the first guide pieces 50 so as to have an inclined posture substantially parallel to the manual feed tray 30.

As shown in FIG. 7, a casing 38 of the feed roller unit 33 is penetrated by the second shaft 35 in the width direction so that the feed roller unit 33 is rotatably supported by the second shaft 35. A cylindrical portion 43 to be penetrated by the second shaft 35 is provided to project on one width-direction side surface of the casing 38. The feed roller unit 33 as a whole is urged toward the manual feed tray 30 by a coil spring 44 (urging unit) wound on the outer circumference of the cylindrical portion 43. Incidentally, the feed roller unit 33 may be urged toward the manual feed tray 30 by its own weight instead of the coil spring 44.

Once the arm bodies 31 are inclined to be substantially parallel to the manual feed tray 30 as described above, the feed roller unit 33 rotates counterclockwise (see FIGS. 3 and 11) around the second shaft 35 due to the urging force. Thus, the feed roller 32 attached to the front end portion of the feed roller unit 33 abuts against the paper P mounting surface of the manual feed tray 30. As shown by the chain double-dashed line in FIG. 11, the folding angle of the feed roller unit 33 with respect to the arm bodies 31 is θ1 when the arm bodies 31 and the feed roller unit 33 are housed in the housing 4 by the closed manual feed tray 30. On the other hand, the folding angle of the feed roller unit 33 with respect to the arm bodies 31 is θ2 (>θ1) when the arm bodies 31 and the feed roller unit 33 are inclined to the outside of the housing 4 by the opened manual feed tray 30. In addition, an angle θ3 of a manual-feed-tray-side surface S1 connecting the base end portion and the front end portion of the feed roller unit 33 with respect to a recording medium mounting surface S2 of the manual feed tray 30 is set to be acute. In this embodiment, strictly, the mounting surface S2 corresponds to the upper surface (shown by the broken line in FIG. 11) of a support plate 61 of a positioning member 60 which will be described later.

A driving force changeover unit 45 for changing over between connection and disconnection as to transfer of the driving force to the feed roller 32 in accordance with the rotating direction of the second shaft 35 is provided in the feed roller unit 33 as shown in FIG. 8. As the driving force changeover unit 45, first inside the casing 38, a driving gear 39 is fixedly attached to the second shaft 35, and a planet gear 40 is rotatably supported on the front end portion of a swinging member 46 fixedly attached to the second shaft 35 and provided in parallel to the driving gear 39. The driving gear 39 and the planet gear 40 gear with each other. In addition, a driven gear 41 and a feed (feed paper) gear 42 gearing with the driven gear 41 are rotatably supported on the casing 38. Further, the feed roller 32 is formed integrally and coaxially with the feed (paper feed) roller 42.

On the inner surface side of the manual feed tray 30 (the top side in the opened state), the positioning member 60 for positioning the paper P mounted on the manual feed tray 30 in the width direction thereof is provided as shown in FIGS. 4 and 9. The positioning member 60 is provided with the substantially rectangular support plate 61, a pair of side plates 62 and a distance adjusting unit 63. The support plate 61 is attached to be laid on the inner surface side of the manual feed tray 30. The support plate 61 is long in the width direction. The side plates 62 are provided to project from the opposite end portions of the support plate 61 in the width direction so as to be opposed to each other in the width direction. The distance adjusting unit 63 is provided for adjusting the width-direction distance between the side plates 62 and 62. The distance adjusting unit 63 uses a well-known unit in which the side plates 62 are linked with two latches 64 disposed in parallel with the feed (paper feed) direction of the paper P on the back surface of the support plate 61 located between the support plate 61 and the manual feed tray 30, and a gear 65 is disposed to gear between the latches 64, as shown in FIG. 9. In this unit, when one of the side plates 62 is moved, the other side plate 62 is interlocked through the latches 64 and the gear 65 so that the paper P can be set in the width-direction central portion of the manual feed tray 30.

In this embodiment, the positioning member 60 is attached to the housing 4 so that the base end portion thereof rotates with a pivot 60*a* as a fulcrum. The pivot 60*a* has a different axis from that of the pivot 30*a* of the manual feed tray 30. Accordingly, as shown in FIG. 4, a pair of flat-plate-like second guide pieces 53 are provided on the inner surface side of the manual feed tray 30 (on the top side in the opened state) so as to be opposed to each other in the width direction of the manual feed tray 30. Thus, the positioning member 60 can perform an open/close operation in accordance with the opening/closing of the manual feed tray 30. The second guide pieces 53 are disposed in positions displaced upstream in the feed (paper feed) direction of the paper P with respect to the first guide pieces 50 provided likewise in the manual feed tray 30. As shown in FIG. 3, slit-like guide grooves 54 long in the feed (paper feed) direction are provided in the second guide pieces 53 so that protrusion portions 66 provided in the width-direction opposite side portions of the support plate 61 so as to project to the outside are slidably fitted into the slit grooves 54. Thus, the positioning member 60 is guided to be opened/closed in accordance with the open/close operation of the manual feed tray 30.

In addition, on the inner surface side of the manual feed tray 30 (on the top side of the opened state), as shown in FIG. 9, a first extension member 57 and a second extension member 58 can be accommodated to be put on top of each other. When the manual feed tray 30 is closed, the first and second extension members 57 and 58 are accommodated to be put on top of each other between the manual feed tray 30 and the support plate 61. The first extension member 57 is disposed slidably on the manual feed tray 30. The second extension member 58 is provided rotatably with respect to the first extension member 57. The manual feed tray 30 itself has a function as a tray only when it is opened. However, as shown in FIG. 4, an extended tray capable of supporting large-size paper stepwise can be formed by pulling out the first and second extension members 57 and 58 put on top of each other or by further rotating and opening the second extension member 58 to the outside.

Description will be made on the operation of the recording medium feed apparatus 2 configured thus. First, the manual feed tray 30 is closed as shown in FIG. 1 in the case of no feed (paper feed) by the manual feed tray 30. In this event, the arm bodies 31 are erected substantially vertically with the first shafts 34 as their pivots down. In addition, the feed roller unit 33 has a folding angle θ1 with respect to the arm bodies 31 so as to be erected substantially vertically and closely to the arm bodies 31. The feed roller unit 33 and the arm bodies 31 are thus housed in the housing 4 on the inner surface side of the manual feed tray 30.

Next, when feed (paper feed) is performed using the manual feed tray 30, the manual feed tray 30 is rotated around the pivot 30*a* and toward the outside of the housing 4 so as to be displaced from the closed state to the opened state. With this operation, the protrusion portions 52 provided in the side portions of the arm bodies 31 are guided along the guide grooves 51 of the first guide pieces 50 of the manual feed tray 30. Thus, the arm bodies 31 are inclined to the outside of the housing 4 with the first shafts 34 as their pivot axis portions respectively. As shown in FIGS. 3 and 11, the arm bodies 31 reach positions substantially parallel to the manual feed tray 30. With the inclination of the arm bodies 31, the feed roller unit 33 attached to the second shaft 35 provided in the front end portions of the arm bodies 31 increases the folding angle with respect to the arm bodies 31 so as to reach a position with the folding angle θ2 (>θ1) in which the feed roller 32 abuts against the paper P mounting surface of the manual feed tray.

In addition, in this state, the surface S1 on the manual feed tray side connecting the base end portion and the front end portion of the feed roller unit 33 is disposed to have an acute angle (θ3<90°) with respect to the recording medium mounting surface S2 of the manual feed tray 30. Accordingly, the user inserts the paper P along the surface S1 inclined downward.

With the displacement operation of the manual feed tray 30 from the closed state to the opened state, the protrusion portions 66 provided in the side portions of the support plate 61 of the positioning member 60 are guided along the guide grooves 54 of the second guide pieces 53 of the manual feed tray 30. Thus, the positioning member 60 is inclined to the outside of the housing 4 with its pivot 60*a* as a fulcrum, so that the support plate 61 is put on the top surface of the manual feed tray 30.

A desired number of sheets of paper P having desired dimensions are then inserted between the manual feed tray 30 (support plate 61) and the feed roller 32. In this event, the feed roller unit 33 is rotated around the second shaft 35 correspondingly to the number of stacked sheets of paper P. Thus, the feed roller unit 33 is lifted up so that the feed roller 32 abuts against the uppermost sheet of paper P.

When the paper P is mounted on the manual feed tray 30 (support plate 61), one of the side plates 62 and 62 of the positioning member 60 is moved to operate the distance adjusting unit 63. Thus, the distance between the side plates 62 and 62 can be adjusted to the width-direction size of the paper P. In addition, the first and second extension members 57 and 58 of the manual feed tray 30 are pulled out or the second extension member 58 is rotated so that the length of the manual feed tray 30 in the feed (paper feed) direction can be extended in accordance with the length of the paper P in the feed (paper feed) direction.

In response to an instruction to record an image on the paper P mounted on the manual feed tray 30, the driving force from the driving source 27 for paper conveyance is transferred to the first shafts 34. When clockwise rotations in FIG. 3 (also see FIG. 5) are applied to the first shafts 34, the driving force is transferred to the second shaft 35 by the driving force transfer unit 36 provided on one of the arm bodies 31. Thus, the second shaft 35 rotates counterclockwise in FIG. 3 (also see FIG. 5). Then, as shown in FIG. 8, the planet gear 40 is rotated downward by the swinging member 46 fixedly attached to the second shaft 35 so that the planet gear 40 and the driven gear 41 gear with each other (the chain line in FIG. 8). Consequently, the rotation of the second shaft 35 is transferred to the feed roller 32 through the driving gear 39, the planet gear 40, the driven gear 41 and the feed (paper feed) gear 42. As a result, the feed roller 32 is driven to rotate clockwise in FIG. 3 (also see FIG. 8) so that only the upper most sheet of paper P is separated and conveyed to a portion just on the upstream side of the first driving roller 16 and the first driven roller 17, which portion is located halfway in the conveyance path 12.

The front edge portion of the paper P is caught thus between the first driving roller 16 and the first driven roller 17. When the first driving roller 16 starts to be driven for conveyance, counterclockwise rotations in FIG. 3 (also see FIG. 5) are applied from the driving source 27 to the first shafts 34 of the arm bodies 31 so that the second shaft 35 rotates clockwise in FIG. 3 (also see FIG. 5). As shown in FIG. 8, the swinging member 46 rotates upward (to stop in a position where it abuts against the inner wall of the casing 38) so that the planet gear 40 and the driven gear 41 are released from linkage with each other (the chain double-dashed line in FIG. 8). As a result, the rotation of the second shaft 35 is not transferred to the feed roller 32. Thus, the feed roller 32 can rotate desirably. The feed roller 32 is driven in accordance with the paper P driven and conveyed by the first driving roller 16. The driven rotation is kept on till the rear edge portion of the paper P leaves the feed roller 32.

In such a manner, in the aforementioned configuration, the arm bodies 31 and the feed roller unit 33 are retained with a reduced folding angle and to be each erected substantially vertically at the time of retraction in spite of the pivot axis portions of the arm bodies 31 installed inside the housing 4. The occupied space in the feed (paper feed) direction inside the housing 4 can be therefore reduced on a large scale.

When the manual feed tray 30 is displaced from the closed state to the opened state, the folding angle of the arm bodies 31 and the feed roller unit 33 increases. That is, the feed roller unit 33 is supported like a pendulum through the arm bodies 31. Accordingly, even when the occupied space of the arm bodies 31 and the feed roller unit 33 at the time of retraction is reduced as described above, the feed roller 32 can be disposed in an optimal position of the manual feed tray 30 on the upstream side in the feed (paper feed) direction by setting the opened-state folding angle θ2 and the length of the arm bodies 31 and the feed roller unit 33. Even when the feed roller 32 is disposed in the optimal position of the manual feed tray 30 on the upstream side in the feed (paper feed) direction, the length between the feed roller 32 and the second shaft 35 serving as the pivot axis portion of the feed roller unit 33 can be secured sufficiently. Thus, the feed roller 32 can be always brought into contact with the uppermost sheet of paper P in a stable position with little change regardless of the number of stacked sheets of paper P. As a result, there is no fear that the feed performance of the feed roller 32 is lost.

In addition, as for the open/close operation of the arm bodies 31, they are guided quickly by the first guide pieces 50 provided in the manual feed tray 30. Accordingly, the operation can be performed without spoiling the operationality of the open/close operation of the manual feed tray 30.

In addition, in the feed roller unit 33, the surface S1 on the manual feed tray 30 side connecting the base end portion and the front end portion of the feed roller unit 33 is disposed to have an acute angle (θ3<90°) with respect to the paper P mounting surface S2 of the manual feed tray 30. That is, the space under the feed roller unit 33 is inclined downward in the feed (paper feed) direction so as to be narrowed. Accordingly, the paper P can be inserted easily if the paper P is inserted along the bottom-side surface of the feed roller unit 33.

Although the reading portion 5 is disposed above the paper delivery tray 24 in the aforementioned description, the invention is not limited to such an arrangement. Further, the housing 4 and the reading portion 5 may be connected with each other so that data can be transmitted/received through a cable or the like.

In addition, the image recording apparatus 1 may be a printer having no reading portion 5.

Further, the recoding system in the invention is not limited to the inkjet system. Not to say, the invention is applicable to image recording apparatus using a laser system, an electrophotographic system, or a thermal transfer system.

In the recording medium feed apparatus, when the manual feed tray is in the opened state, the front end portion of the feed roller unit is located downward in a feed direction with respect to the base end portion, and a surface on the manual feed tray side connecting the base end portion and the front end portion of the feed roller unit is disposed at an acute angle with respect to the mounting surface of the manual feed tray.

Therefore, when the recording media are mounted on the manual feed tray, the recording media can be inserted between the manual feed tray and the feed roller by guide of the downward inclination of the manual feed tray side surface connecting the base end portion and the front end portion of the feed roller unit. Thus, the work of inserting the recording media becomes easy.

In the recording medium feed apparatus, the arm body further includes a first shaft provided in the first end portion, a second shaft provided in the second end portion, and a link unit which links the first shaft and the second shaft, the arm body is attached to the housing with the first shaft and the feed roller is attached to the second shaft, and the driving source is linked to the first shaft, the driving force by the driving source is transferred from the first shaft to the second shaft through the link unit and transferred from the second shaft to the feed roller through the feed roller unit.

Therefore, the feed roller unit is linked with the driving source for conveying the recording medium, indirectly through the arm body. Thus, the driving force can be transferred to the feed roller easily.

In the recording medium feed apparatus, the feed roller unit is provided with a driving force changeover unit which changes over between presence and absence of the transfer of the driving force from the second shaft to the feed roller in accordance with a rotation direction of the second shaft.

Therefore, whether the driving force should be transferred to the feed roller or not can be changed over easily in accordance with the rotation direction of the second shaft. Accordingly, the function of the feed roller can be changed over from a driving roller to a driven roller quickly, for example, as soon as the recording medium starts to be conveyed by the driving roller provided upstream with respect to the feed roller and for conveyance.

The recording medium feed apparatus has an urging unit that urges the feed roller unit toward the manual feed tray.

Therefore, the folding angle of the feed roller unit with respect to the arm body increases quickly as soon as the arm body is inclined. Thus, the feed roller can abut against the uppermost surface of the recording medium surely.

What is claimed is:

1. A recording medium feed apparatus comprising:

a manual feed tray provided openably and closably with respect to a housing of an image recording apparatus having a recording portion that records an image on a recording medium;

a feed roller that feeds the recording portion with a recording medium mounted on the manual feed tray in an opened state;

an arm body having a first end portion and a second end portion, the first end portion being rotatably attached to the housing;

a feed roller unit having a front end portion and a base end portion, the front end portion being provided with the feed roller, the base end portion being rotatably attached to the second end portion of the arm body; and a driving source provided in the housing and that transfers a driving force to the feed roller, wherein the arm body and the feed roller unit are housed substantially vertically inside the housing when the manual feed tray is in a closed state with respect to the housing, and as the manual feed tray changes from the closed state to the opened state, the arm body in a substantially vertical state is inclined toward an outside of the housing, while a folding angle of the feed roller unit with respect to the arm body increases so that the feed roller abuts against an uppermost surface of a recording medium mounted on a mounting surface of the manual feed tray.

2. The recording medium feed apparatus according to claim 1, wherein when the manual feed tray is in the opened state, the front end portion of the feed roller unit is located downward in a feed direction with respect to the base end portion, and a surface on the manual feed tray side connecting the base end portion and the front end portion of the feed roller unit is disposed at an acute angle with respect to the mounting surface of the manual feed tray.

3. The recording medium feed apparatus according to claim 1, wherein the arm body further includes a first shaft provided in the first end portion, a second shaft provided in the second end portion, and a link unit which links the first shaft and the second shaft, the arm body is attached to the housing with the first shaft and the feed roller is attached to the second shaft, and the driving source is linked to the first shaft, the driving force by the driving source is transferred from the first shaft to the second shaft through the link unit and transferred from the second shaft to the feed roller through the feed roller unit.

4. The recording medium feed apparatus according to claim 3, wherein the feed roller unit is provided with a driving force changeover unit which changes over between presence and absence of the transfer of the driving force from the second shaft to the feed roller in accordance with a rotation direction of the second shaft.

5. The recording medium feed apparatus according to claim 1, further comprising:

an urging unit that urges the feed roller unit toward the manual feed tray.

* * * * *